US008037699B2

(12) United States Patent
Lee et al.

(10) Patent No.: US 8,037,699 B2
(45) Date of Patent: Oct. 18, 2011

(54) HEAT EXCHANGER AND AIR CONDITIONER USING THE SAME

(75) Inventors: Sangmu Lee, Tokyo (JP); Akira Ishibashi, Tokyo (JP); Takuya Matsuda, Tokyo (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 0 days.

(21) Appl. No.: 12/919,069

(22) PCT Filed: Apr. 17, 2009

(86) PCT No.: PCT/JP2009/057782
§ 371 (c)(1),
(2), (4) Date: Aug. 24, 2010

(87) PCT Pub. No.: WO2009/131072
PCT Pub. Date: Oct. 29, 2009

(65) Prior Publication Data

US 2011/0000254 A1 Jan. 6, 2011

(30) Foreign Application Priority Data

Apr. 24, 2008 (JP) ..... 2008-113805

(51) Int. Cl.
*F25B 1/00* (2006.01)

(52) U.S. Cl. ..... 62/115; 62/515

(58) Field of Classification Search ..... 62/259.1, 62/515, 498, 115; 165/151, 179, 181; 29/890.044, 29/890.046
See application file for complete search history.

(56) References Cited

U.S. PATENT DOCUMENTS 4,480,684 A 11/1984 Onishi et al.
(Continued)

FOREIGN PATENT DOCUMENTS

EP 0 122 612 A1 10/1984
(Continued)

OTHER PUBLICATIONS

Transaltion of JP 2000-218332 A to Hiroshi.*
(Continued)

*Primary Examiner* — Mohammad Ali
(74) *Attorney, Agent, or Firm* — Buchanan Ingersoll & Rooney PC

(57) ABSTRACT

When forming fins and heat transfer tubes by aluminum material, a pressure loss in the tube does not increase and a heat exchanger can be provided having heat transfer performance equal to or higher than a copper tube. The heat exchanger includes fins made of an aluminum material having a low deformation resistance and heat transfer tubes made of an aluminum material having a higher deformation resistance than the aluminum material forming the fins, and on whose internal surface the groove is provided to penetrate the fin to be fixed. It is also arranged that the tube axial direction (a) of the inner surface of the heat transfer tube and the direction (b) of the groove provided on the internal surface of the heat transfer tube are substantially parallel. In this case, the groove direction (b) forms an angle of 0 degrees to 2 degrees with respect to the tube axial direction (a) of the inner surface of the heat transfer tube. The depth of the groove of the heat transfer tube after tube expansion is 0.2 mm to 0.3 mm, and the top width of the ridge top portion is 0.08 mm to 0.18 mm. Further, the number of grooves of the heat transfer tube 20 is 40 to 60, and an apex angle $\alpha$ is 5 degrees to 20 degrees.

11 Claims, 8 Drawing Sheets

U.S. PATENT DOCUMENTS

| | | | | | |
|---|---|---|---|---|---|
| 4,716,959 | A | * | 1/1988 | Aoki | 165/152 |
| 4,901,553 | A | * | 2/1990 | Kuroda et al. | 72/97 |
| 5,010,643 | A | * | 4/1991 | Zohler | 29/890.048 |
| 5,217,547 | A | | 6/1993 | Ishikawa et al. | |
| 5,275,234 | A | * | 1/1994 | Booth | 165/133 |
| 5,381,600 | A | * | 1/1995 | Patel | 29/890.044 |
| 5,404,942 | A | * | 4/1995 | Patel | 165/179 |
| 5,564,184 | A | * | 10/1996 | Dinh | 29/890.044 |
| 5,653,222 | A | * | 8/1997 | Newman | 126/653 |
| 5,806,173 | A | * | 9/1998 | Honma et al. | 29/727 |
| 6,129,143 | A | * | 10/2000 | Hasegawa et al. | 165/133 |
| 6,886,349 | B1 | | 5/2005 | Curicuta et al. | |
| 7,117,584 | B2 | * | 10/2006 | Nakadeguchi et al. | 29/727 |
| 7,571,759 | B2 | * | 8/2009 | Inagaki et al. | 165/80.4 |
| 2003/0019614 | A1 | | 1/2003 | Iwamoto et al. | |
| 2004/0211056 | A1 | * | 10/2004 | Nakadeguchi et al. | 29/727 |
| 2005/0061492 | A1 | | 3/2005 | Kurihara et al. | |
| 2005/0072562 | A1 | * | 4/2005 | Hall | 165/182 |
| 2005/0121173 | A1 | * | 6/2005 | Inagaki et al. | 165/80.3 |
| 2005/0155750 | A1 | | 7/2005 | Mitchell et al. | |
| 2007/0039611 | A1 | * | 2/2007 | Benvenuti | 126/652 |
| 2007/0062677 | A1 | | 3/2007 | Usui et al. | |
| 2007/0251091 | A1 | | 11/2007 | Minami et al. | |
| 2008/0047683 | A1 | * | 2/2008 | Takahashi | 165/41 |
| 2008/0087408 | A1 | | 4/2008 | Maezawa et al. | |

FOREIGN PATENT DOCUMENTS

| | | | |
|---|---|---|---|
| EP | 0 499 257 | A3 | 8/1992 |
| JP | 60-142195 | A | 7/1985 |
| JP | 62-148080 | | 7/1987 |
| JP | 05-90172 | U | 12/1993 |
| JP | 6-079380 | A | 3/1994 |
| JP | 06-194092 | | 7/1994 |
| JP | 6-331294 | A | 11/1994 |
| JP | 08-313112 | A | 11/1996 |
| JP | 9-253775 | A | 9/1997 |
| JP | 10-166034 | | 6/1998 |
| JP | 11-351791 | A | 12/1999 |
| JP | 2000-121270 | A | 4/2000 |
| JP | 2000-205782 | A | 7/2000 |
| JP | 2000-218332 | A | 8/2000 |
| JP | 2001-153571 | | 6/2001 |
| JP | 2001-246479 | A | 9/2001 |
| JP | 2003-042676 | A | 2/2003 |
| JP | 2003-222487 | A | 8/2003 |
| JP | 2003-329385 | A | 11/2003 |
| JP | 2004-230450 | A | 8/2004 |
| JP | 2004-245534 | A | 9/2004 |
| JP | 2005-131662 | A | 5/2005 |
| JP | 2005-201622 | A | 7/2005 |
| JP | 2005-288502 | A | 10/2005 |
| JP | 2006-322661 | A | 11/2006 |
| WO | 2005/114087 | A3 | 12/2005 |
| WO | WO 2006/025465 | A1 | 3/2006 |
| WO | 2007/054642 | A1 | 5/2007 |

OTHER PUBLICATIONS

International Search Report (PCT/ISA/210) issued on May 19, 2009, by Japanese Patent Office as the International Searching Authority for International Application No. PCT/JP2009/057782.

Decision of Refusal dated Feb. 15, 2011 from Japanese Patent Office issued in corresponding Japanese Patent Application No. 2010-509163, with English-language translation.

Office Action from Japanese Patent Office issued in corresponding Japanese Patent Application No. 2010-509163 dated Nov. 30, 2010, with English Translation.

Extended European Search Report issued on Jun. 8, 2011 in corresponding EP Application No. 09 73 5950.

* cited by examiner

HEAT EXCHANGER AND AIR CONDITIONER USING THE SAME

TECHNICAL FIELD

The present invention relates to a heat exchanger incorporating internally grooved heat transfer tubes and an air conditioner using the same.

BACKGROUND ART

Conventionally, in a heat exchanger of an air conditioner or the like, internally grooved heat transfer tubes are generally arranged at a regular interval and a refrigerant flows therein. A tube axial direction and groove extending direction on the tube inner face form a certain angle (7°-30°), multiple grooves are processed to form ridges, and it is arranged that a fluid flowing in the tube is subjected to a phase transition (condensation and evaporation). In such a phase transition, the performance of the heat transfer tube has been improved by increasing a surface area in the tube, a fluid agitating effect by internal grooves, a liquid membrane retention effect between grooves by a capillary effect of the grooves, and the like (see, for example, Patent Document 1).

PRIOR ART DOCUMENT

Patent Document

[Patent Document 1] Japanese Unexamined Patent Application Publication No 60-142195 (page 2 and FIG. 1)

DISCLOSURE OF INVENTION

Problems to be Solved by the Invention

Conventional heat transfer tubes, including the heat transfer tube disclosed in Patent Document 1, are generally made of a metallic material of copper or a copper alloy. When an aluminum material is employed for such a material for the sake of improved processability and weight reduction, it is easily deformed since deformation resistance is low compared with copper. However, when the heat transfer tube is expanded in order to fix on a fin, ridge-form on the inner surface may become tilted and the heat transfer performance equal to or more than that of a copper tube cannot be obtained.

Further, since the strength of aluminum material is lower than that of a copper material, it is necessary to make a sheet thickness of a groove bottom of the heat transfer tube thick. Therefore, there is a problem that a pressure drop in the heat transfer tube increases.

The present invention is made to solve the described problems above. It is therefore an object of the present invention to provide a heat exchanger in which, even though fins and heat transfer tubes are composed of an aluminum-based material, a pressure loss within the heat transfer tube does not increase, and heat transfer performance equal to or superior to that of a copper tube can be obtained. It is also an object of the present invention to provide an air conditioner using such a heat exchanger.

Means for Solving the Problems

A heat exchanger of the present invention comprises:

a fin made of an aluminum-based material having a low deformation resistance; and a heat transfer tube made of an aluminum-based material having a deformation resistance higher than the aluminum-based material forming the fin, the heat transfer tube being provided with internal grooves and penetrating the fin to be fixed, wherein a tube axial direction of an inner surface of the heat transfer tube and a direction of the grooves provided on the inner surface of the heat transfer tubes are substantially in parallel.

ADVANTAGES

According to the heat exchanger of the present invention, since the tube axial direction of the inner surface of the heat transfer tube is substantially parallel to the groove direction, a heat transfer performance within the tube can be made to be equal to or more than that of a copper tube without increasing a pressure loss as compared with the conventional copper-based heat transfer tube. Further, even when the heat transfer tube is expanded, the ridges formed on the inner surface of the tube do not become tilted, and an adhesion between the heat transfer tube and the fin is improved to an extent equal to or superior to that of a copper tube, and thus high efficiency is attained. Furthermore, the heat exchanger of the present invention has a structure that is easily manufactured and disassembled, and therefore recycling efficiency is improved.

BEST MODE FOR CARRYING OUT THE INVENTION

First Embodiment

Figure 1:
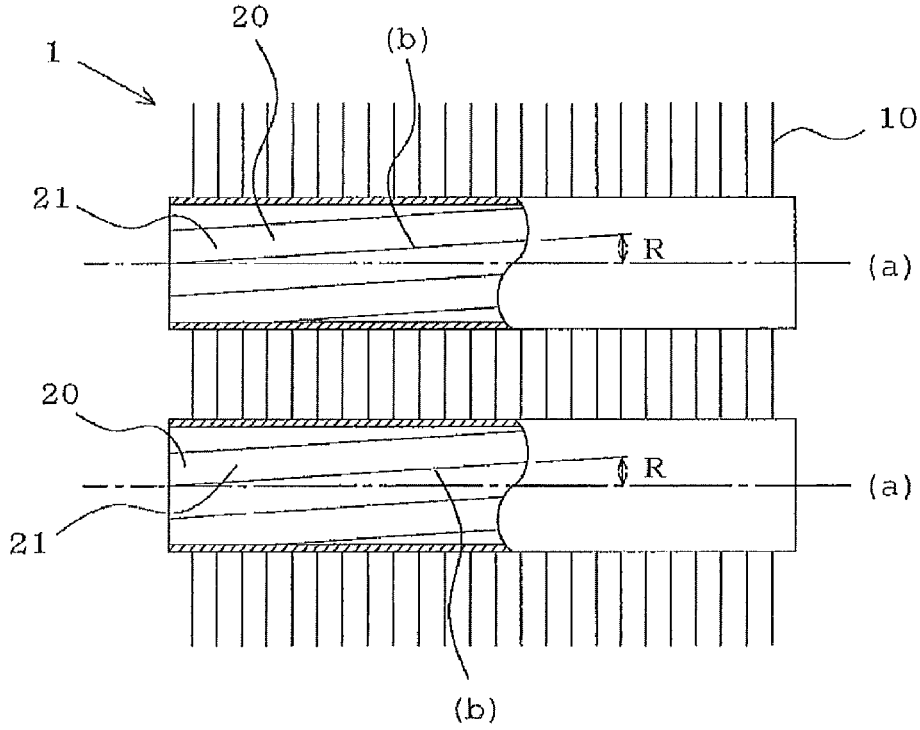
FIG. 1 is a horizontal sectional view showing a heat exchanger of a first embodiment of the present invention.
Figure 2:
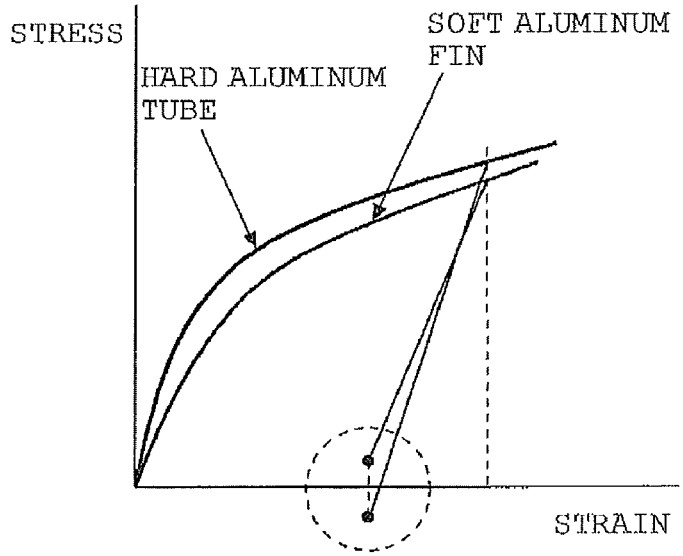
FIG. 2 is a diagram showing the relationship between the strain and stress of a hard aluminum tube and a soft aluminum fin of the first embodiment.
Figure 3:
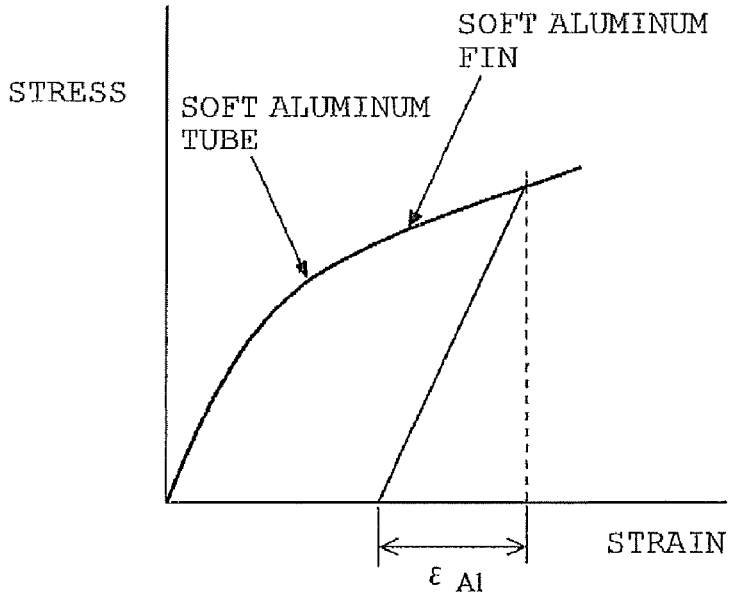
FIG. 3 is a diagram showing the relationship between the strain and stress of a soft aluminum tube and a soft aluminum fin.

FIG. 1 is a elevational sectional view of a heat exchanger that is cut in a vertical direction of the first embodiment of the present invention; FIG. 2 is a diagram showing the relationship between the strain and stress of an aluminum tube having a high deformation resistance and an aluminum fin having a low deformation resistance; FIG. 3 is a diagram showing the relationship between the strain and stress of an aluminum tube having a low deformation resistance and an aluminum fin having a low deformation resistance; and FIG. 4 is a diagram showing the relationship between the lead angle and the rate of increase of an evaporation pressure loss.

In FIG. 1, a heat exchanger 1 includes fins 10 and heat transfer tubes 20 penetrating the fins 10. The fin 10 is made of an (soft) aluminum-based material having a low deformation resistance. On the other hand, the heat transfer tube 20 is made of a material consisting of (hard) aluminum or an aluminum alloy (hereinafter referred to as "aluminum-based") having a higher deformation resistance than the fin 10. In the case the aluminum alloy, a series 3000 aluminum in which 0.2% to 1.8% of manganese (Mn) is added to pure aluminum is employed. As shown in FIG. 2, a difference in strain therebetween is used to maintain the adhesion between the heat transfer tube 20 and the fin 10, thereby obtaining a heat exchanger with high efficiency. Incidentally, in the case when the heat transfer tube 20 and the fin 10 are made of aluminum material having the same rigidity, no difference in strain as shown in FIG. 3, so that the adhesion between the heat transfer tube 20 and the fin 10 of the heat exchanger 1 is poor, unable to achieve a high heat exchange rate.

Grooves 21 are provided in an inner surface of the heat transfer tube 20, and the tube axial direction (a) and the direction in which the grooves 21 extend (b) are substantially parallel. The angle formed by them, that is a lead angle R is 0 to 2 degrees.

Figure 4:
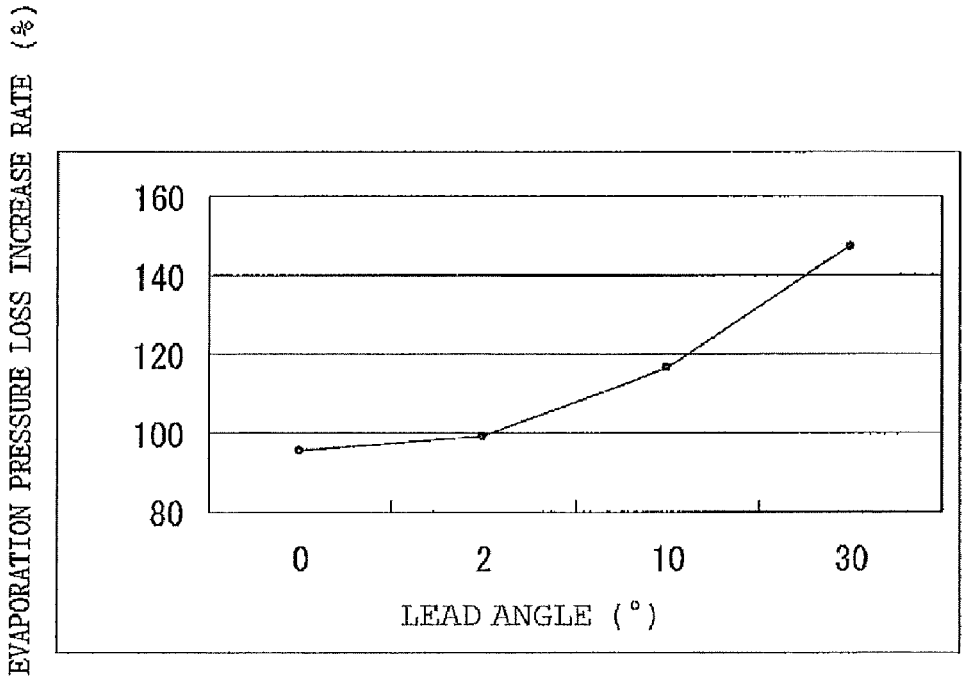
FIG. 4 is a diagram showing the relationship between the lead angle and the rate of increase of an evaporation pressure loss of the first embodiment.

As shown in FIG. 4, in the heat exchanger 1, the lead angle R of the groove 21 of the heat transfer tube 20 is set in the range of 0 to 2 degrees because the strength of aluminum is lower than that of a copper material, and therefore it is necessary to make the board thickness from the groove bottom of the heat transfer tube 20 thick. If the lead angle R of the groove 21 of the heat transfer tube 20 is set to 2 degrees or more, the ridges become tilted, resulting in an increase of a pressure loss in the tube.

Thus, no stream that flows over the groove 21 being generated, and therefore the heat transfer rate is improved without increasing a pressure loss in the tube.

The above heat exchanger is used as an evaporator or a condenser in a refrigeration cycle in which a compressor, a condenser, a throttle device and an evaporator are successively connected through tubes and in which a refrigerant is used as a working fluid contributing to improving a coefficient of performance (COP). Further, as the refrigerant, any one of an HC single refrigerant or a HC mixed refrigerant, R32, R410A, R407C, and carbon dioxide may be used. The heat exchange efficiency between these refrigerants and the air can be improved.

Second Embodiment

Figure 5:
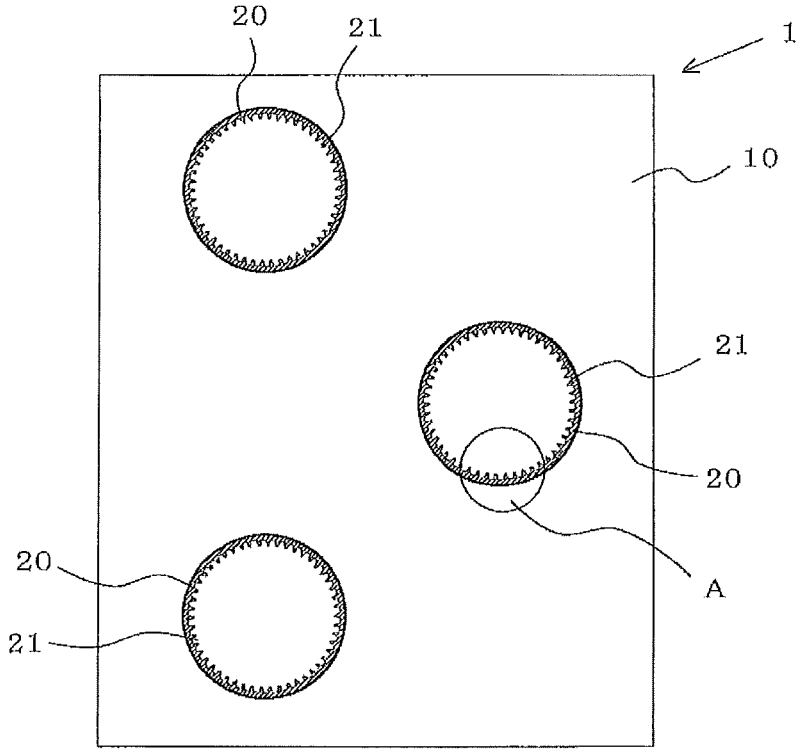
FIG. 5 is a side sectional view of the heat exchanger of a second embodiment of the present invention.
Figure 6:
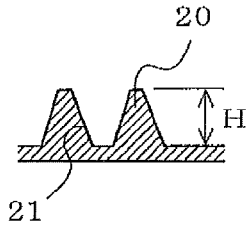
FIG. 6 is an enlarged sectional view showing a part marked "A" in FIG. 5.
Figure 7:
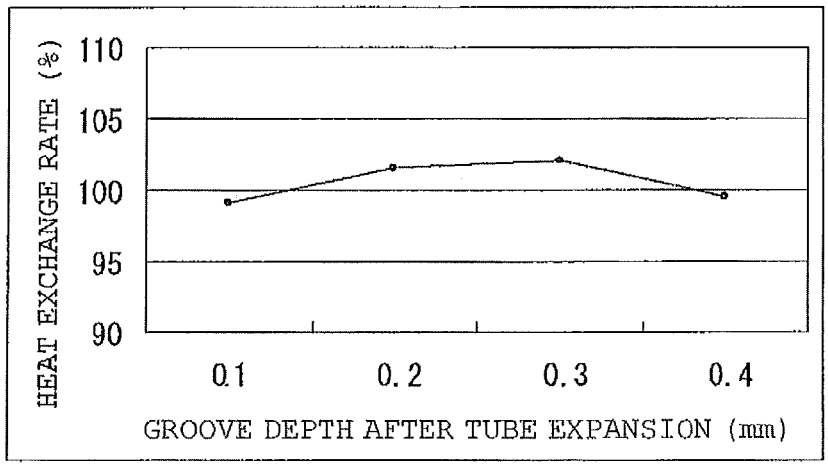
FIG. 7 is a diagram showing the relationship between the groove depth after tube expansion and the heat exchange rate of the second embodiment.

FIG. 5 is a side sectional view of a heat exchanger 1 that is cut in a vertical direction of a second embodiment of the present invention; FIG. 6 is an enlarged sectional view of a part marked "A" in FIG. 5; and FIG. 7 is a diagram showing the relationship between the groove depth after tube expansion and the heat exchange rate. Incidentally, elements identical to or corresponding to those of the first embodiment have the same reference symbols, and the descriptions thereof are omitted (this can also be applied to the following embodiments).

In FIG. 7, regarding the heat transfer tube 20 (see FIGS. 5 and 6) with internal grooves, the larger the depth (H) of the groove 21 after tube expansion, the higher the heat transfer rate. However, when the depth H of the groove 21 exceeds 0.3 mm, the increase in a pressure loss becomes larger than the increase in the heat transfer rate, and therefore the heat exchange rate is lowered. On the other hand, when the depth H of the groove 21 after tube expansion is less than 0.2 mm, the heat transfer rate is not improved.

Therefore, in the heat transfer tube 20 with internal grooves of the present second embodiment, the depth H of the groove 21 after tube expansion is set as 0.2 mm to 0.3 mm.

Third Embodiment

Figure 8:
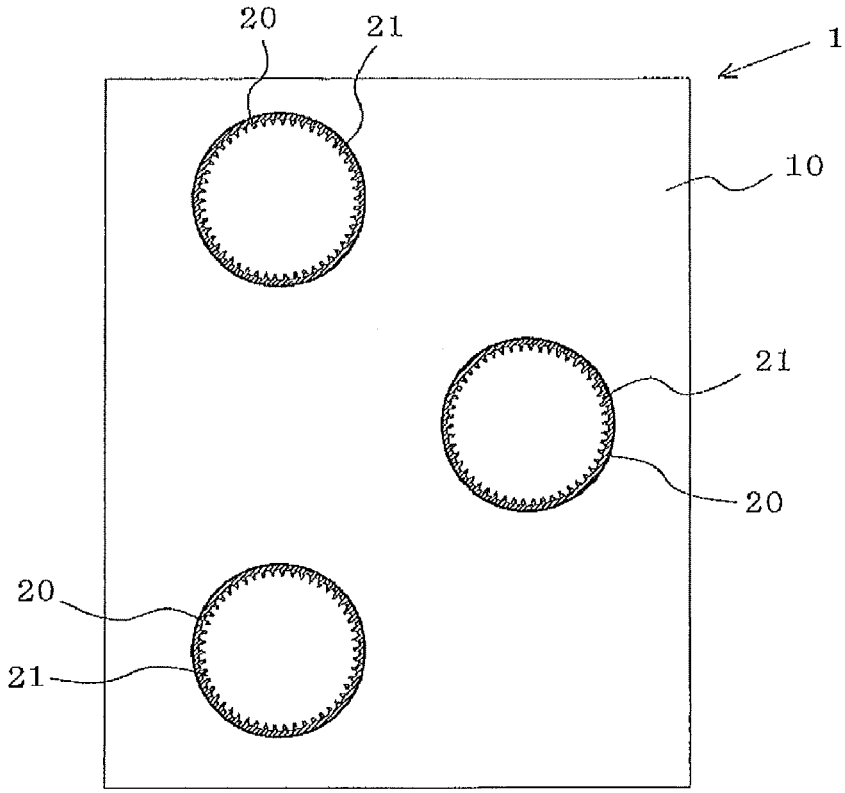
FIG. 8 is a side cross sectional view of the heat exchanger of a third embodiment of the present invention.
Figure 9:
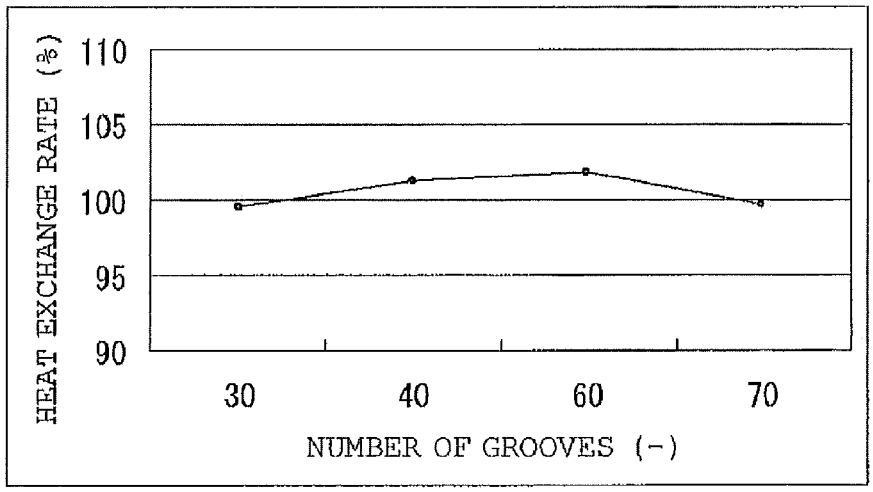
FIG. 9 is a diagram showing the relationship between the number of grooves and the heat exchange rate of the third embodiment.

FIG. 8 is a side cross sectional view of a heat exchanger that is cut in a vertical direction of the third embodiment of the present invention; and FIG. 9 is a diagram showing the relationship between the number of grooves and the heat exchange rate.

In FIG. 9, a heat transfer area of the heat transfer tube 20 with internal grooves (see FIG. 8) increases as the number of the grooves 21 increases, resulting in an increase in a heat transfer rate. However, when the number of the grooves 21 exceeds 60, the cross-sectional area of the groove becomes small, and a refrigerant liquid membrane overflows from the grooves 21 and up to the ridge top portion is covered with the refrigerant liquid membrane, resulting in lowering of the heat transfer rate. On the other hand, when the number of the grooves 21 becomes less than 40, the heat transfer area decreases, resulting in lowering of the heat transfer rate.

Therefore, in the heat transfer tube 20 with internal grooves of the third embodiment, the number of the grooves 21 is set as 40 to 60.

Fourth Embodiment

Figure 10:
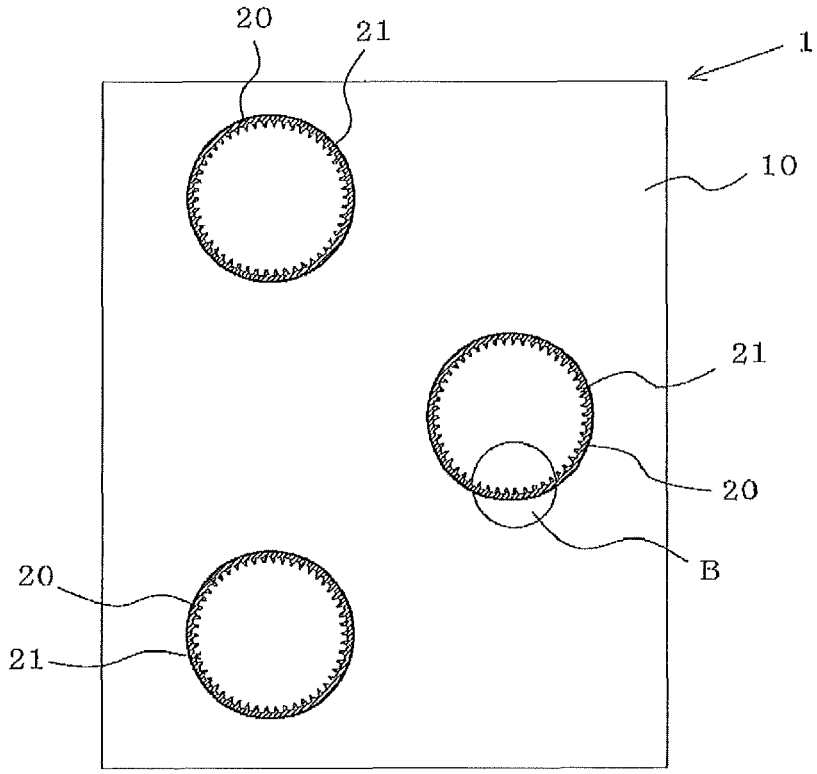
FIG. 10 is a side cross sectional view of a heat exchanger of a fourth embodiment of the present invention.
Figure 11:
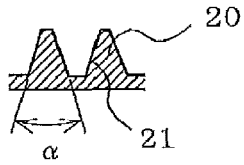
FIG. 11 is an enlarged sectional view of a part marked "B" in FIG. 10.

FIG. 10 is a side cross sectional view of a heat exchanger that is cut in a vertical direction of the fourth embodiment of the present invention; FIG. 11 is an enlarged sectional view of a part marked "B" in FIG. 10; and FIG. 12 is a diagram showing the relationship between the apex angle and the heat exchange rate.

Figure 12:
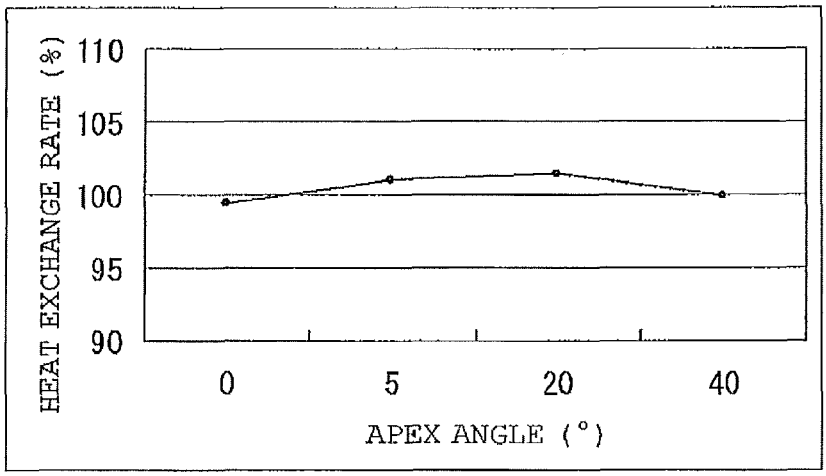
FIG. 12 is a diagram showing the relationship between an apex angle and the heat exchange rate of the fourth embodiment.

In FIG. 12, regarding the heat transfer tube 20 with internal grooves (see FIGS. 10 and 11), the smaller the apex angle ($\alpha$) of the grooves 21, the larger the heat transfer area, and therefore the heat transfer rate is increased. However, when the apex angle ($\alpha$) is smaller than 5 degrees, the processability when manufacturing the heat exchanger is significantly decreased, and the heat exchange rate is lowered. On the other hand, when the apex angle ($\alpha$) exceeds 20 degrees, the cross sectional area of the groove becomes small, whereby the refrigerant liquid membrane overflows from the groove 21 and up to the ridge top portion is covered with the refrigerant liquid membrane, resulting in lowering of the heat transfer rate.

Therefore, the apex angle ($\alpha$) of the heat transfer tube 20 with internal grooves of the fourth embodiment is set as 5 degrees to 20 degrees.

Fifth Embodiment

Figure 13:
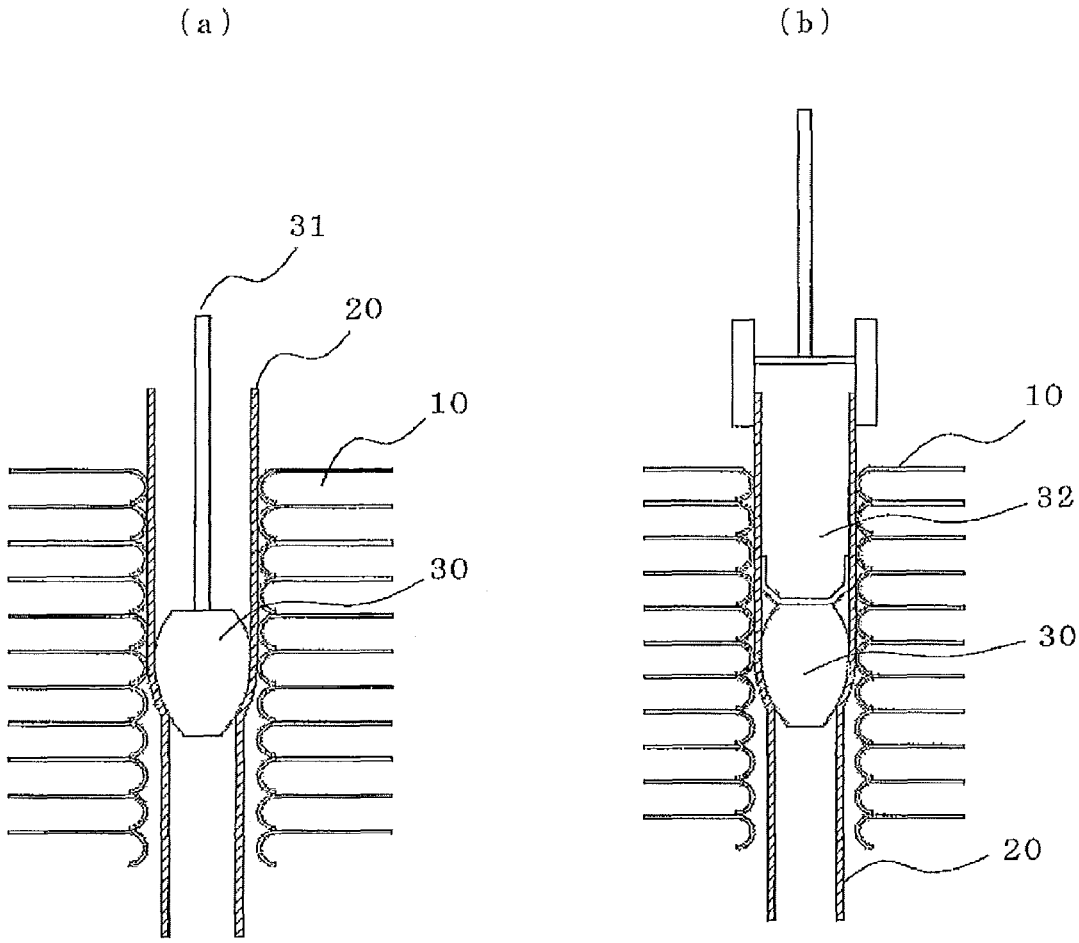
FIG. 13 is an elevational sectional view showing a manufacturing method of a heat exchanger of a fifth embodiment of the present invention.

FIGS. 13(*a*) and (*b*) are elevational sectional views showing method of manufacturing a heat exchanger that is cut in a vertical direction of a fifth embodiment of the present invention. Incidentally, the heat exchanger of an indoor unit side and that of an outdoor unit side are both manufactured by a similar procedure.

As shown in FIG. 13, each heat transfer tube 20 is processed so as to be bent at a middle portion in the longitudinal direction with a predetermined bend pitch so that it takes hairpin shape, and a plurality of hairpin tubes are produced. Next, these hairpin tubes are inserted into a plurality of fins 10 arranged in parallel to one another with a predetermined interval, and then the hairpin tube is expanded by a mechanical tube-expansion method in which a tube-expanding ball 30 is pressed into the hairpin tube by a rod 31 (see FIG. 13(*a*)) or by a hydraulic tube-expansion method in which the tube-expanding ball 30 is pressed by the hydraulic pressure of a fluid 32 (see FIG. 13(*b*)). The fins 10 and the hairpin tube, i.e., heat transfer tube 20, are joined in the described manner, and the heat exchanger 1 is thus manufactured.

In the heat exchanger 1 of the fifth embodiment, since the multiple of fins 10 and the hair pin tubes (heat transfer tube 20) are fixed only by expanding the hairpin tube, that is a constituent element of the heat exchanger, by a mechanical tube-expansion method or a hydraulic tube-expansion method, the heat exchanger 1 can be easily manufactured.

Sixth Embodiment

In the fifth embodiment, the case in which the fin 10 and the hairpin tube (heat transfer tube 20) are fixed by expanding the hairpin tube was shown. In the sixth embodiment, the expansion rate of the heat transfer tube 20 of the heat exchanger 1 is further specified.

In the sixth embodiment, when the hairpin tube is expanded by a mechanical tube-expansion method or a hydraulic tube-expansion method, the expansion rate of the heat transfer 20 of the heat exchanger 1 is set at 105.5% to 107.5%, thereby improving the adhesion between the heat transfer tube 20 and the fins 10 of the heat exchanger and therefore the heat exchanger 1 with high efficiency is obtained. However, when the expansion rate of the heat transfer tube 20 of the heat exchanger 1 is 107.5% or more, collapse of the ridge top portions and fin collar cracks occur, resulting in a poor adhesion between the heat transfer tube 20 and the fins 10. On the other hand, when the expansion rate of the heat transfer tube 20 of the heat exchanger 1 is less than 105.5%, the adhesion between the heat transfer tube 20 and the fins 10 is poor, and thus a high heat exchange rate cannot be obtained.

Therefore, the tube expansion rate of the heat transfer tube 20 of the heat exchanger 1 is set as 105.5% to 107.5% when expanding the hairpin tube of the sixth embodiment.

When the expansion rate is specified as described above, no variation in products occurs.

Incidentally, in the fifth and sixth embodiments, the fin 10 and the hairpin tube (heat transfer tube 20) are joined only by expanding the heat transfer tube 20, however, it is also possible to perform perfect bonding by brazing, thereby allowing even higher reliability.

Seventh Embodiment

Figure 14:
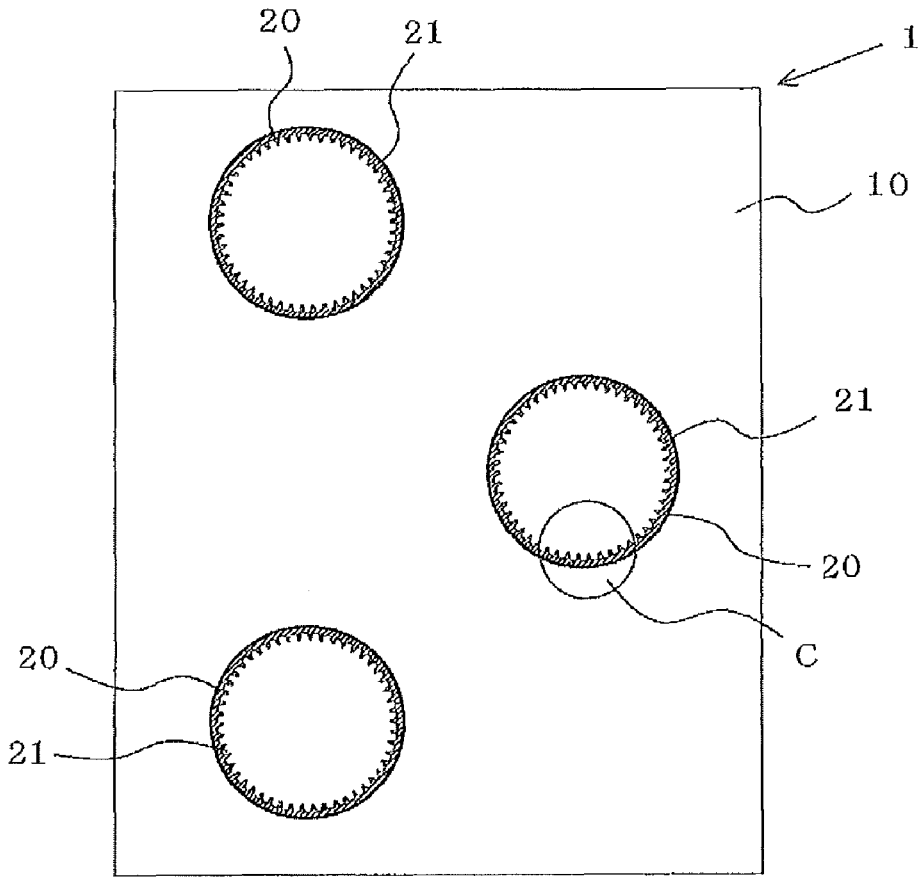
FIG. 14 is a side sectional view of the heat exchanger of a seventh embodiment of the present invention.
Figure 15:
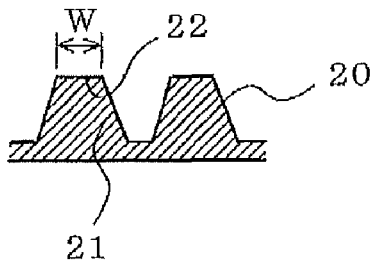
FIG. 15 is an enlarged sectional view of a part marked "C" in FIG. 14.

FIG. 14 is a side sectional view of a heat exchanger that is cut in a vertical direction of the seventh embodiment of the present invention; FIG. 15 is an enlarged sectional view of a part marked "C" in FIG. 14.

In the heat exchanger 1 of the seventh embodiment, a top width (W) of the ridge top portion 22 (see FIGS. 14 and 15) after the heat transfer tube 20 is expanded is set in the range of 0.08 to 0.18 mm.

Since aluminum has a low deformation resistance and is easily deformed as compared with copper, the collapse and tilting of the ridge top portion 22 become worse. By making the top width (W) of the ridge top portion 22 after the heat transfer tube 20 is expanded to 0.08 mm or more, the amount of collapse and tilting of the ridges of the grooves 21 can be reduced. On the other hand, when the top width (W) exceeds 0.18 mm, the cross sectional area of the groove becomes small, and refrigerant liquid membrane overflows from the groove 21 and up to the ridge top portions 22 is covered with a refrigerant liquid membrane, resulting in lowering of the heat transfer rate.

Thus the adhesion between the heat transfer tube 20 and the fins 10 of the heat exchanger 1 is improved, thereby achieving the heat exchanger 1 with high efficiency.

Eighth Embodiment

Figure 16:
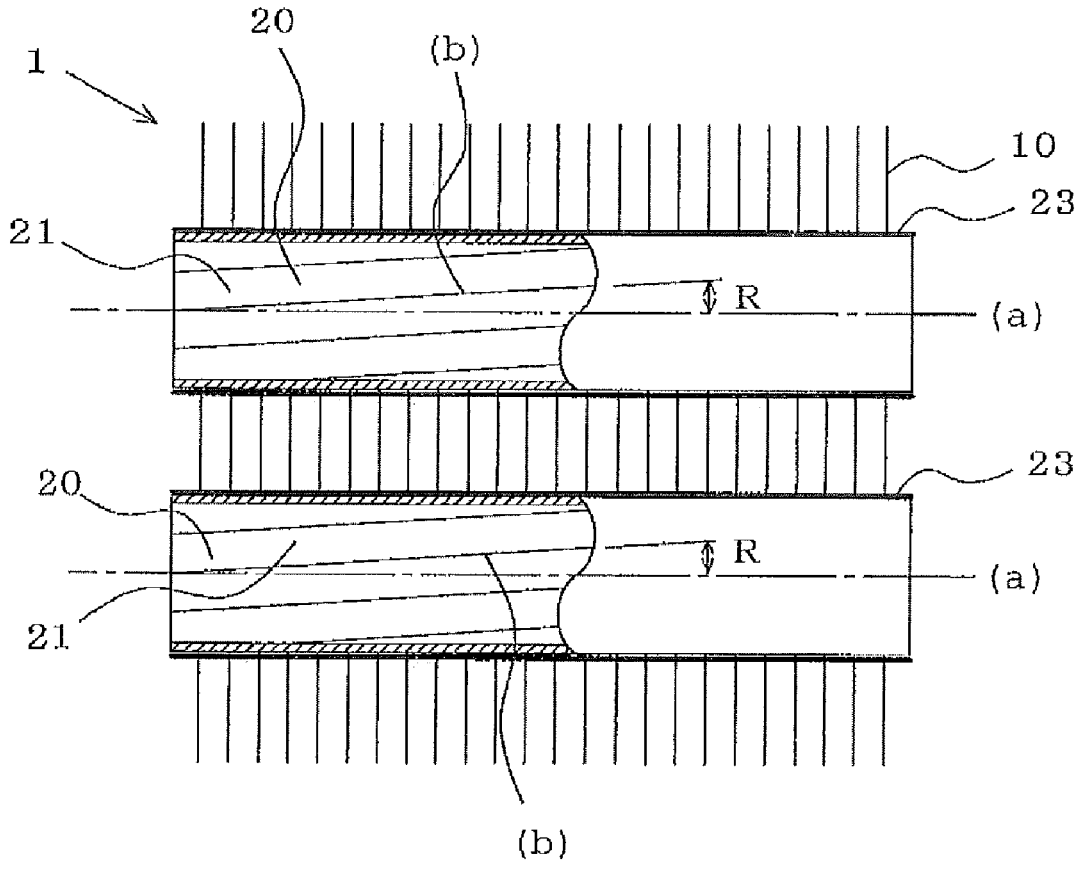
FIG. 16 is an elevational sectional view of the heat exchanger of an eighth embodiment of the present invention.

FIG. 16 is a elevational sectional view of a heat exchanger that is cut in a vertical direction of the eighth embodiment of the present invention.

In the eighth embodiment, the outer surface of the heat transfer tube 20 of the heat exchanger 1 is zinc thermally-sprayed and diffusion-processed, so that a corrosion resistance effect of the heat transfer tube 20 is expected, and the reliability of the refrigeration system is improved. Incidentally, it is desirable to form a zinc diffusion layer 23 of about 50 μm to 100 μm on an aluminum base material after the zinc thermal spraying and the diffusion processing.

Ninth Embodiment

In the ninth embodiment, any one of the heat exchangers described in the first to eighth embodiments of the present invention is used for an air conditioner.

It is possible to achieve an air conditioner having high efficiency using a heat exchanger having excellent heat transfer performance without increasing the pressure loss in the tube.

Examples

Hereinafter, examples of the present invention will be described in comparison with comparative examples which do not fall within the scope of the present invention.

As shown in Table 1, the heat exchangers 1 made of an aluminum alloy are manufactured (Examples 1 and 2) whose outer diameter is 7 mm, a bottom thickness of the groove 21 is 0.5 mm, and a lead angle is 0 degrees and 2 degrees.

Further, as comparative examples, heat exchangers made of an aluminum alloy are manufactured (Comparative Examples 1 and 2) whose outer diameter is 7 mm, a bottom thickness of the groove 21 is 0.5 mm, and a lead angle R is 10 degrees and 30 degrees. Further, a heat exchanger made of copper was manufactured (Comparative Example 3) whose outer diameter is 7 mm, a bottom thickness is 0.25 mm, and a lead angle R is 30 degrees.

TABLE 1

| | Outer diameter (mm) | Bottom thickness (mm) | Lead angle | Evaporation pressure drop during |
|---|---|---|---|---|
| Example 1 | 7 | 0.5 | 0 degrees | 95.0 |
| Example 2 | 7 | 0.5 | 2 degrees | 99.0 |
| Comparative Example 1 | 7 | 0.5 | 10 degrees | 116.0 |
| Comparative Example 2 | 7 | 0.5 | 30 degrees | 147.0 |
| Comparative Example 3 | 7 | 0.25 | 30 degrees | 100.0 |

As is apparent from Table 1, the heat exchangers 1 of Examples 1 and 2 exhibit a lower evaporation pressure drop and higher heat transfer performance in the tube than the heat exchangers of Comparative Examples 1 to 3.

Next, as shown in Table 2, the heat exchangers 1 made of aluminum are manufactured (Comparative Examples 3 and 4) whose an outer diameter is 7 mm, a bottom thickness of the groove 21 is 0.5 mm, a lead angle is 0 degrees, and a groove depths after tube expansion are 0.2 mm and 0.3 mm.

Further, as comparative examples, heat exchangers made of aluminum are manufactured (Comparative Examples 4 and 5) whose outer diameter is 7 mm, a bottom thickness of the groove 21 is 0.5 mm, a lead angle is 0 degrees, and a groove depths after tube expansion are 0.1 ram and 0.4 mm. Further, a heat exchanger made of copper is manufactured (Comparative Example 6) whose outer diameter is 7 mm, a bottom thickness of the groove 21 is 0.25 mm, a lead angle is 30 degrees, and a groove depth after tube expansion is 0.15 mm.

TABLE 2

| | Outer diameter (mm) | Bottom thickness (mm) | Lead angle | Groove depth after tube expansion (mm) | Heat exchange rate |
|---|---|---|---|---|---|
| Example 3 | 7 | 0.5 | 0 degrees | 0.2 | 101.5 |
| Example 4 | 7 | 0.5 | 0 degrees | 0.3 | 102.0 |
| Comparative Example 4 | 7 | 0.5 | 0 degrees | 0.1 | 99.0 |
| Comparative Example 5 | 7 | 0.5 | 0 degrees | 0.4 | 99.5 |
| Comparative Example 6 | 7 | 0.25 | 30 degrees | 0.15 | 100.0 |

As is apparent from Table 2, the heat exchangers 1 of Examples 3 and 4 exhibit a higher heat exchange rate and higher heat transfer performance in the tube than the heat exchangers of Comparative Examples 4 to 6.

Next, as shown in Table 3, the heat exchangers 1 made of aluminum are manufactured (Examples 5 and 6) whose outer diameter is 7 mm, a bottom thickness of the groove 21 is 0.5 mm, a lead angle is 0 degrees, and a number of grooves is 40 and 60.

Further, as comparative examples, heat exchangers made of aluminum were manufactured (Comparative Examples 7 and 8) whose outer diameter is 7 mm, a bottom thickness is 0.5 mm, a lead angle is 0 degrees, and a number of the grooves is 30 and 70. Furthermore, a heat exchanger made of copper is manufactured (Comparative Example 9) whose outer diameter is 7 mm, a bottom thickness is 0.25 mm, a lead angle is 30 degrees, and a number of grooves is 50.

TABLE 3

| | Outer diameter (mm) | Bottom thickness (mm) | Lead angle | Number of grooves | Heat exchange rate |
|---|---|---|---|---|---|
| Example 5 | 7 | 0.5 | 0 degrees | 40 | 101.2 |
| Example 6 | 7 | 0.5 | 0 degrees | 60 | 101.8 |
| Comparative Example 7 | 7 | 0.5 | 0 degrees | 30 | 99.5 |
| Comparative Example 8 | 7 | 0.5 | 0 degrees | 70 | 99.6 |
| Comparative Example 9 | 7 | 0.25 | 30 degrees | 50 | 100.0 |

As is apparent from Table 3, the heat exchangers 1 of Examples 5 and 6 exhibit a higher heat exchange rate and higher heat transfer performance in the tube than the heat exchangers of Comparative Examples 7 to 9.

Next, as will be shown in Table 4, the heat exchangers 1 made of aluminum are manufactured (Examples 7 and 8) whose outer diameter is 7 mm, a bottom thickness of the groove 21 is 0.5 mm, a lead angle is 0 degrees, and an apex angle is 5 degrees and 20 degrees.

Further, as comparative examples, heat exchangers made of aluminum are manufactured (Comparative Examples 10 and 11) whose outer diameter is 7 mm, a bottom thickness is 0.5 mm, a lead angle is 0 degrees, and an apex angle is 0 degrees and 40 degrees. Furthermore, a heat exchanger made of copper is manufactured (Comparative Example 12) whose outer diameter is 7 mm, a bottom thickness of the groove 21 is 0.25 mm, a lead angle is 30 degrees, and an apex angle is 15 degrees.

TABLE 4

| | Outer diameter (mm) | Bottom thickness (mm) | Lead angle | Apex angle | Heat exchange rate |
|---|---|---|---|---|---|
| Example 7 | 7 | 0.5 | 0 degrees | 5 | 101.0 |
| Example 8 | 7 | 0.5 | 0 degrees | 20 | 101.3 |
| Comparative Example 10 | 7 | 0.5 | 0 degrees | 0 | 99.3 |
| Comparative Example 11 | 7 | 0.5 | 0 degrees | 40 | 99.8 |
| Comparative Example 12 | 7 | 0.25 | 30 degrees | 15 | 100.0 |

As is apparent from Table 4, the heat exchangers 1 of Examples 7 and 8 exhibit a higher heat exchange rate and higher heat transfer performance in the tube than the heat exchangers of Comparative Examples 10 to 12.

Next, as shown in Table 5, the heat exchangers 1 made of aluminum are manufactured (Examples 9, 10, and 11) whose outer diameter is 7 mm, a bottom thickness of the groove 21 is 0.5 mm, a lead angle is 0 degrees, and a ridge top width is 0.08 mm, 0.15 mm, or 0.18 mm.

Further, as a comparative example, a heat exchanger made of aluminum is manufactured (Comparative Example 13) whose outer diameter is 7 mm, a bottom thickness of the groove 21 is 0.5 mm, a lead angle is 0 degrees, and a ridge top width is 0.07 mm.

A tube expansion test is performed using the heat exchangers of Examples 9 to 11 and of Comparative Example 13 as described above. The tube expansion test is performed by inserting a tube-expanding ball 30 into an internally grooved tube to expand the tube with an expansion rate of 106%, and the sectional surface perpendicular to the tube axis of the internally grooved tube is observed with an optical microscope after the tube expansion. Then, the amount of collapse of the inner surface of the tube was examined. A reduction amount of the ridge top portion 22 was 0.04 mm or less is judged as "O" and that exceeded 0.04 mm is judged as "X."

TABLE 5

| | Outer diameter (mm) | Bottom thickness (mm) | Lead angle | Ridge top width (mm) | Judgment |
|---|---|---|---|---|---|
| Example 9 | 7 | 0.5 | 0 degrees | 0.08 | ○ |
| Example 10 | 7 | 0.5 | 0 degrees | 0.15 | ○ |
| Example 11 | 7 | 0.5 | 0 degrees | 0.18 | ○ |
| Comparative Example 13 | 7 | 0.5 | 0 degrees | 0.07 | X |

As is apparent from Table 5, the heat exchangers 1 of Examples 9 to 11 exhibit a small amount of collapse and tilting of the ridges of the groove as compared with the heat exchanger of Comparative Example 13, and the adhesion is improved between the heat transfer tube 20 and fin 10 of the heat exchanger 1.

REFERENCE NUMERALS

1 heat exchanger
10 fin
20 heat transfer tube
21 groove
22 ridge top portion
23 zinc diffusion layer
30 tube-expanding ball
31 rod
32 fluid
α apex angle
H groove depth
R lead angle
W ridge top width

The invention claimed is:

1. A heat exchanger comprising:

a fin made of an aluminum-based material having a deformation resistance; and a heat transfer tube made of an aluminum-based material having a deformation resistance higher than the aluminum-based material forming the fin, the heat transfer tube being provided with internal grooves and penetrating the fin to be fixed, wherein a tube axial direction of an inner surface of the heat transfer tube and a direction of the grooves provided on the inner surface of the heat transfer tubes are substantially in parallel, the heat transfer tube is joined with the fin by being expanded by a mechanical tube-expansion method or a hydraulic tube-expansion method, and a top width of a ridge top portion of the heat transfer tube after expansion is 0.08 mm to 0.18 mm.

2. The heat exchanger of claim 1, wherein the heat transfer tube and the fin joined by tube expansion are adhered to each other by brazing.

3. The heat exchanger of claim 1, wherein an expansion rate of the heat transfer tube is 105.5% to 107.5% by the mechanical tube-expansion method or the hydraulic tube-expansion method.

4. The heat exchanger of claim 1, wherein a depth of the grooves of the heat transfer tube after expansion is 0.2 mm to 0.3 mm.

5. The heat exchanger of claim 1, wherein the number of the grooves of the heat transfer tube is 40 to 60.

6. The heat exchanger of claim 1, wherein an apex angle of the grooves of the heat transfer tube is 5 degrees to 20 degrees.

7. The heat exchanger of claim 1, wherein an outer surface of the heat transfer tube is subjected to zinc thermal spraying and diffusion processing and has a zinc diffusion layer of about 50-100 μm on the aluminum based material.

8. A refrigeration cycle apparatus wherein, a compressor, a condenser, a throttle device, and an evaporator are successively connected through tubes, a refrigerant is used as a working fluid, and the heat exchanger of claim 1 is employed as the evaporator or the condenser.

9. The refrigeration cycle apparatus of claim 8, wherein the refrigerant is selected from any one of an HC single refrigerant, a HC mixed refrigerant, R32, R410A, R407C, and carbon dioxide.

10. An air conditioner wherein the heat exchanger of claim 1 is used.

11. The heat exchanger of claim 1, wherein the angle of the grooves is from greater than 0 degree to 2 degrees with respect to the tube axial direction of the inner surface of the heat transfer tube.

* * * * *